US005402916A

United States Patent [19]

Nottingham et al.

[11] Patent Number: 5,402,916

[45] Date of Patent: Apr. 4, 1995

[54] DUAL CHAMBER SPRAYER WITH METERING ASSEMBLY

[75] Inventors: John R. Nottingham, Hunting Valley; Richard O. McCarthy, Strongsville; Nick E. Stanca, Westlake, all of Ohio

[73] Assignee: Nottingham Spirk Design Associates, Cleveland, Ohio

[21] Appl. No.: 82,831

[22] Filed: Jun. 22, 1993

[51] Int. Cl.[6] ..... B61D 5/00

[52] U.S. Cl. ..... 222/134; 222/144.5; 222/136; 222/383.1

[58] Field of Search ..... 222/134–145, 222/321, 383, 385

[56] References Cited

U.S. PATENT DOCUMENTS

| | | | |
|---|---|---|---|
| D. 247,302 | 2/1978 | Federico et al. . | |
| D. 310,632 | 9/1990 | Hutton . | |
| D. 310,958 | 10/1990 | Biesecker . | |
| D. 336,846 | 6/1993 | Proctor . | |
| 664,237 | 12/1900 | Deming . | |
| 1,948,401 | 2/1934 | Smith et al. . | |
| 3,194,426 | 7/1965 | Brown, Jr. . | |
| 3,269,389 | 8/1966 | Meurer et al. . | |
| 3,303,970 | 2/1967 | Breslau et al. . | |
| 3,338,523 | 8/1967 | Tibbitt . | |
| 3,592,385 | 7/1971 | Smith . | |
| 3,749,290 | 7/1973 | Micallef . | |
| 3,770,206 | 11/1973 | Tada . | |
| 3,786,963 | 1/1974 | Metzler, III . | |
| 3,843,030 | 10/1974 | Micallef . | |
| 3,935,971 | 2/1976 | Papoff et al. | 222/134 |
| 4,013,228 | 3/1977 | Schneider . | |
| 4,073,252 | 2/1978 | Steyns et al. . | |
| 4,082,222 | 4/1978 | Boris . | |
| 4,082,223 | 4/1978 | Nozawa . | |
| 4,153,203 | 5/1979 | Tada . | |
| 4,155,487 | 5/1979 | Blake . | |
| 4,165,812 | 8/1979 | Jennison . | |
| 4,230,277 | 10/1980 | Tada . | |
| 4,345,718 | 8/1982 | Horvath . | |
| 4,355,739 | 10/1982 | Vierkotter . | |
| 4,365,751 | 12/1982 | Saito et al. . | |
| 4,480,768 | 11/1984 | Martin . | |
| 4,489,861 | 12/1984 | Saito et al. . | |
| 4,503,998 | 3/1985 | Martin . | |
| 4,527,741 | 7/1985 | Garneau . | |
| 4,538,745 | 9/1985 | Dunning et al. . | |
| 4,558,821 | 12/1985 | Tada et al. . | |
| 4,618,076 | 10/1986 | Silvenis . | |

(List continued on next page.)

OTHER PUBLICATIONS

Take 5 TM Industrial Cleaning System advertising literature, the seller having an address at 1901 Via Burton, Anaheim, Calif. 92806 (2 pages) (product corresponds to U.S. Patent No. 5,152,461 issued Oct. 6, 1992 to Proctor, listed on p. 6).

*Primary Examiner*—Andres Kashnikow
*Assistant Examiner*—Kenneth De Rosa
*Attorney, Agent, or Firm*—Calfee Halter & Griswold

[57] ABSTRACT

A hand-actuated multiple-container trigger sprayer includes a sprayer head assembly removably connected to a plurality of fluid containers. The sprayer head assembly has an outer housing, a nozzle attached to the housing, pump mechanism enclosed within the housing, and tubing fluidly connecting each of the plurality of fluid containers with the pump mechanism in the housing. A trigger or lever actuates the pump mechanism to draw fluid through the tubing from each of the plurality of fluid containers and to discharge the fluid through the nozzle. A metering device is located between the fluid containers and the pump mechanism and is accessible externally from the housing to selectively control the amount of fluid drawn from the containers. The metering device includes flow paths to the pump mechanism for each of the fluid containers. The diameter and length of at least one of the flow paths can be controlled to selectively control the amount of fluid drawn from the fluid containers.

25 Claims, 9 Drawing Sheets

U.S. PATENT DOCUMENTS 4,624,413 11/1986 Corsette .
4,640,444 2/1987 Bundschuh .
4,646,969 3/1987 Sorm et al. .
4,691,849 9/1987 Tada .
4,705,191 11/1987 Itzel et al. .
4,726,496 2/1988 Dolan .
4,773,562 9/1988 Gueret .
4,790,454 12/1988 Clark et al. .
4,815,663 3/1989 Tada .
4,819,835 4/1989 Tasaki .
4,826,048 5/1989 Skorka et al. .
4,826,052 5/1989 Micallef .
4,832,230 5/1989 Janowitz .
4,893,729 1/1990 Iggulden et al. .
4,898,307 2/1990 Tiramani .
4,911,361 3/1990 Tada .
4,915,263 4/1990 Corba .
4,925,066 5/1990 Rosenbaum .
4,940,186 7/1990 Tada .
4,944,431 7/1990 Blake .
4,953,791 9/1990 Tada .
4,955,511 9/1990 Blake .
4,982,900 1/1991 Blake .
4,993,594 2/1991 Becker et al. .
5,009,342 4/1991 Lawrence et al. .
5,114,049 5/1992 Knicherbocker .
5,114,052 5/1992 Tiramani et al. .
5,152,431 10/1992 Gardner et al. .
5,152,461 10/1992 Proctor .
5,199,604 4/1993 Palmer et al. ..... 222/136 X

DUAL CHAMBER SPRAYER WITH METERING ASSEMBLY

FIELD OF THE INVENTION

The present invention relates generally to sprayers, and more particularly to hand-actuated trigger sprayers.

BACKGROUND

Hand-actuated trigger sprayers are known. Some commercially-available trigger sprayers include a spray head assembly having a sprayer housing, a discharge nozzle, a pump mechanism, and a trigger or lever. The spray head assembly is typically removably connected to a single fluid container or bottle. A rigid rubber tube extends from the fluid container to the pump mechanism in the spray head assembly. Actuation of the trigger draws fluid from the container and discharges (sprays) the fluid through the nozzle. Some of these trigger sprayers can limit or control the amount and/or direction of the spray through the nozzle by screwing the nozzle into or out of the housing.

Examples of such a trigger sprayer are shown in Bundschuh, U.S. Pat. No. 4,640,444; Tada, U.S. Pat. No. 3,770,206; Schneider, U.S. Pat. No. 4,013,228; Steynes, et al., U.S. Pat. No. 4,072,252; Buras, U.S. Pat. No. 4,082,222; Saito, U.S. Pat. No. 4,489,861; Sorm, et al., U.S. Pat. No. 4,646,969; Micalief, U.S. Pat. No. 3,749,290; Micalief, U.S. Pat. No. 4,826,052; Tada, U.S. Pat. No. 4,558,821; Tada, U.S. Pat. No. 4,153,203; Corsette, U.S. Pat. No. 4,624,413; and Saito, U.S. Pat. No. 4,365,751.

While single-container trigger sprayers have had wide-spread acceptance in the consumer market, it is generally not possible to easily modify or alter the concentrate of the fluid in the container during use. That is, the concentrate comes premixed in a manufacturer-specified ratio. The user cannot otherwise change or alter the concentrate ratio for different applications without the burden of removing the sprayer housing and adding additional fluid directly into the container.

Multiple-container, hand-held trigger sprayers have also been developed which can selectively dispense two or more different fluids in user-selected ratios. In these types of trigger sprayers, a different fluid is located within each container, for example, soap concentrate in one container and water in another container. A tube or pipe extends into each container, and a mixing chamber is provided for mixing the fluids. Actuation of the trigger draws fluid from the containers for mixing in the mixing chamber and for discharge through the nozzle. A fluid ratioing device allows the user to control the fluid drawn from at least one of the containers. The user can thereby select the amount of concentrate for a particular application (for example, one ratio for windows, and another ratio for countertops) simply by setting the ratioing device appropriately.

Examples of multiple-container trigger sprayers include Metzler III, U.S. Pat. No. 3,786,963; Vierkotter, U.S. Pat. No. 4,355,739; Lawrence, et al., U.S. Pat. No. 5,009,342; Gardner, et al., U.S. Pat. No. 5,152,431; and Proctor, U.S. Pat. No. 5,152,461.

Although the multiple-container trigger sprayers described above provide certain benefits in being able to control the ratio of different fluids dispensed from the containers, these trigger sprayers are not without drawbacks. For example, some of these trigger sprayers include complex valve assemblies and housing structures which increase the overall cost of the trigger sprayer. The containers or bottles for these sprayers can also have designs which are cumbersome or difficult to grasp and use.

In any case, there is a demand in the industry for improved hand-held trigger sprayers, and in particular, for an inexpensive, simple and easy-to-use, multiple-container trigger sprayer which can discharge fluids from the containers based upon user-specified ratios.

SUMMARY OF THE INVENTION

The present invention provides a new and useful hand-held trigger sprayer which has multiple containers, is simple and easy to use, and which can be manufactured inexpensively.

The trigger sprayer of the present invention includes a spray head assembly removably mounted to multiple fluid containers. The spray head assembly has a sprayer housing, a nozzle, a pump mechanism, and a trigger or lever. A metering device is also included within the spray head assembly for regulating the ratio of fluid drawn from the containers into the pump mechanism. Flexible and rigid tubing extends from the metering device in the spray head assembly into each fluid container for drawing fluid out of the containers.

The metering device within the spray head assembly allows user-selected ratios of fluid to be drawn from the containers and sprayed through the nozzle in the spray head. The metering device includes first and second metering components which are located in contacting face-to-face relation with each other. The contacting surfaces of the metering components define flow paths between the fluid containers and the pump mechanism. A first flow path comprises a pair of circumferentially-extending channels, and a bridge channel which extends between and interconnects the circumferentially-extending channels. One of the circumferentially-extending channels is fluidly connected to one of the fluid containers, while the other of the circumferentially-extending channels is fluidly connected to the pump mechanism. Both of the circumferentially-extending channels have a diameter which varies across the length of the respective channel.

The metering components are movable rotatable relative to each other to adjust the location of the bridge channel along the circumferentially-extending channels. The relative positioning of the bridge channel along the circumferentially extending channels determines the diameter and length of the first flow path between the fluid container and the pump mechanism. The diameter and length of the first flow path can be adjusted across a wide range to meter the amount of fluid drawn from the one container.

The contacting surfaces of the metering components also define a second flow path between a second of the containers and the pump mechanism. The second flow path comprises a crescent-shaped trough interconnecting an entrance bore and a discharge bore. The entrance bore in the second flow path is fluidly connected to a second fluid container, while the discharge bore is fluidly connected to the pump mechanism. The relative positioning of the metering components determines the positioning of the crescent-shaped trough with respect to the entrance bore and the discharge bore—and hence the amount of fluid which can be drawn from the second fluid container to the pump mechanism. The second flow path can be completely open or completely closed depending upon the position of the metering components.

When the trigger of the sprayer is repeatedly squeezed and released, fluid is drawn up from the containers through the first and second flow paths in the metering device and mixed within a mixing chamber in the pump mechanism. The mixed fluid in the mixing chamber flows through an orifice into a discharge chamber as additional fluid is drawn into the mixing chamber. The fluid in the discharge chamber is then sprayed through the nozzle when the trigger is again squeezed.

The fluid containers for the trigger sprayer preferably comprise a pair of interlocking containers each of which has a D-shaped, partially-threaded, neck portion. The D-shaped neck portions are designed to cooperate to removably attach the containers to a threaded cap on the spray head assembly and thereby secure the containers together. The neck portions can be easily removed from the spray head assembly and the containers separated for refilling.

It is therefore one advantage of the present invention to provide a metering device for a trigger sprayer which allows the user to select a wide range of fluid ratios for spraying through the nozzle in the spray head assembly.

It is another advantage of the present invention to provide a multiple-container trigger sprayer which is inexpensive to manufacture and is simple and easy to use.

Other advantages of the present invention will become apparent from the following detailed description and accompanying drawings which form a part of the specification.

DETAILED DESCRIPTION OF THE PREFERRED EMBODIMENT

Figure 2A:
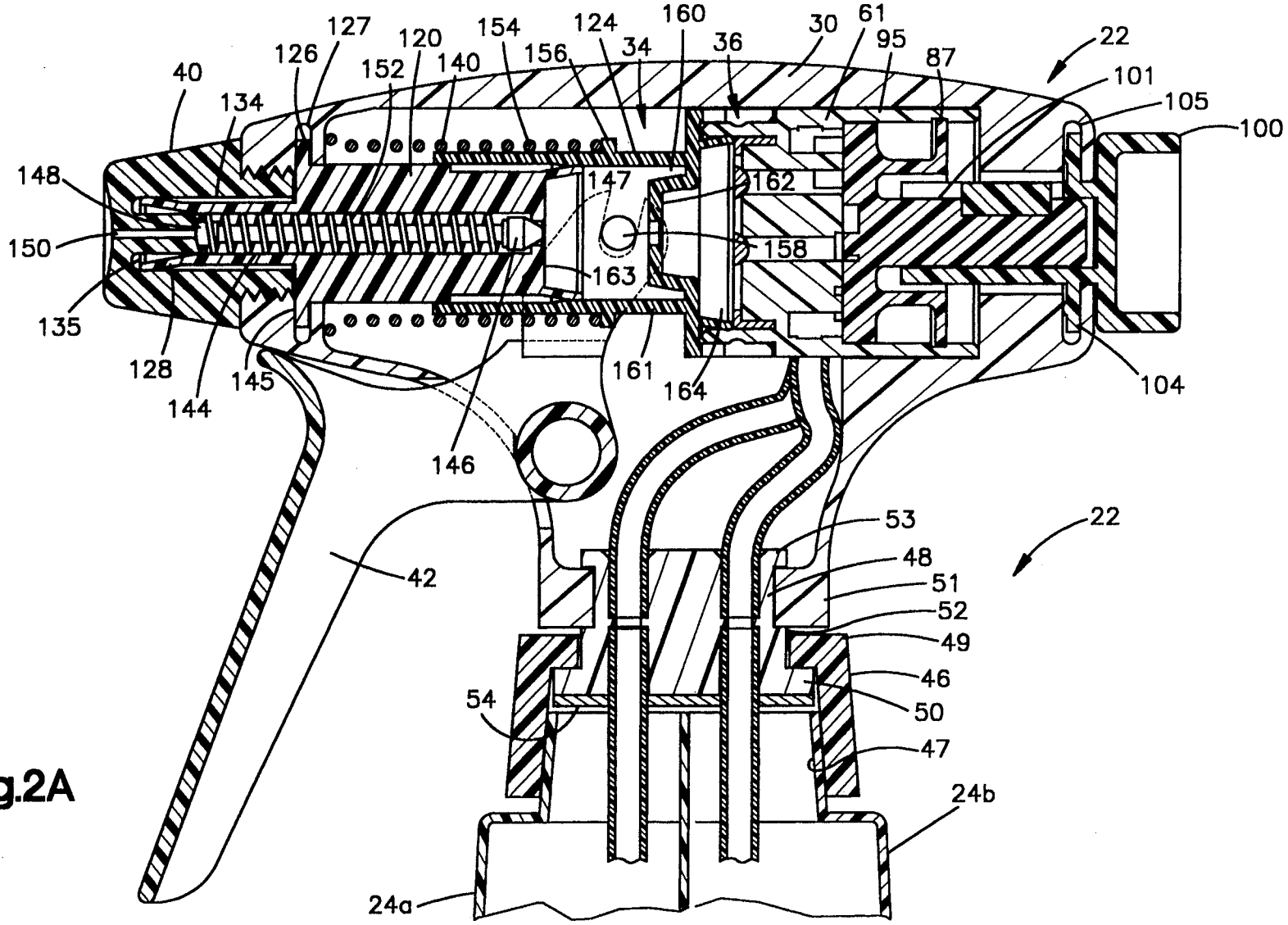
FIG. 2A is a cross-sectional side view of the sprayer head for the trigger sprayer, with the trigger sprayer in a closed or locked position.
Figure 2B:
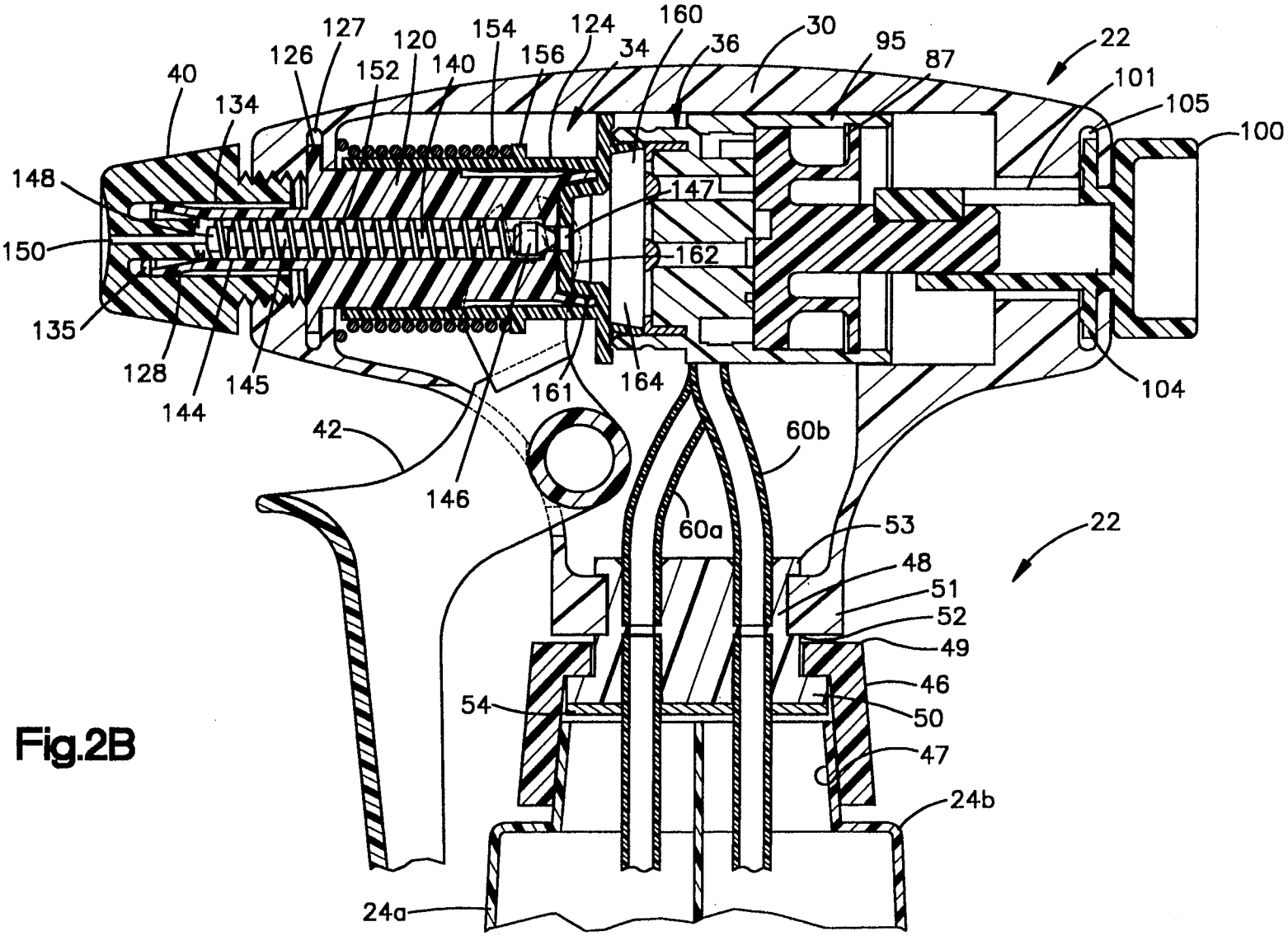
FIG. 2B is a cross-section and side view of the sprayer head similar to FIG. 1, but with the trigger sprayer in an open or unlocked position with the trigger being squeezed.
Figure 3:
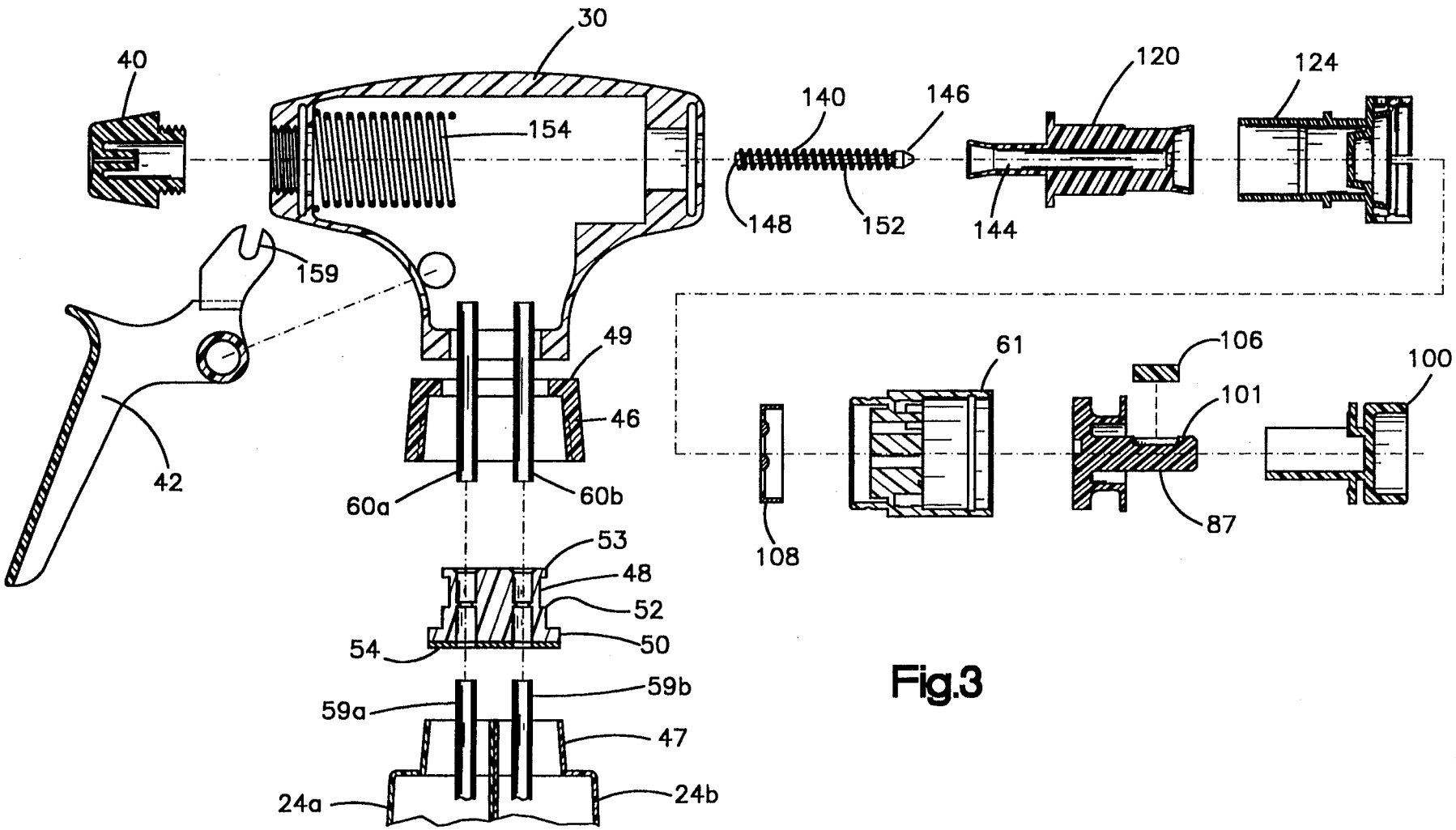
FIG. 3 is a cross-sectional, side exploded view of the components of the trigger sprayer.
Figure 4:
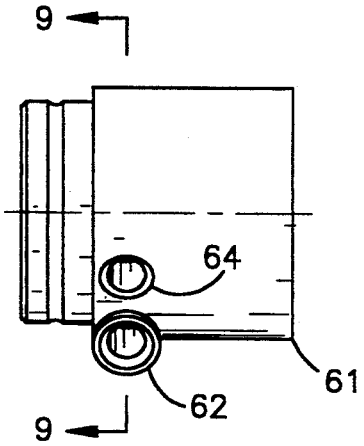
FIG. 4 is a side view of the metering valve for the metering device in the sprayer head.

Referring to the drawings, and initially to FIGS. 1–3, a hand-actuated, multiple-container, trigger sprayer constructed according to the principles of the present invention is indicated generally at 20. The trigger sprayer includes a sprayer head assembly, indicated generally at 22, formed preferably from molded plastic components; and a plurality of fluid containers, indicated generally at 24 (and labeled **24*a*, 24*b***) formed preferably from molded or blown plastic components. As will be discussed herein in more detail, the trigger sprayer allows user-selected ratios of fluid from the containers to be drawn into the sprayer head assembly and discharged, i.e., sprayed in a stream or spray. The trigger sprayer thereby provides different ratios of fluids for different spray applications.

The sprayer head assembly of the present invention includes an outer housing 30 comprised of one or more housing members formed from plastic or other relatively inexpensive, rigid material and fastened together as appropriate. The housing 30 encloses a pump mechanism, indicated generally at 34, and a metering device, indicated generally at 36. A nozzle 40 is threadably received within an opening in the front of the spray housing 30; while a lever or trigger 42 is pivotally connected within the housing (at 44) and extends outwardly and downwardly therefrom.

The sprayer housing 30 is removably connected to the fluid containers 24 by cap 46. Cap 46 includes an inner threaded bore which is screwed onto a corresponding threaded neck 47 (FIGS. 2A, 2B, 3) formed by the top of containers 24. The cap 46 is rotatingly connected to a retaining tube 48 extending through an opening in the bottom of the sprayer head housing 30. Cap 46 includes an inwardly-projecting flange 49 which is received for rotating movement within a groove formed by lower flange 50 on retainer tube 48 and shoulder 51 of sprayer head housing 30. Retaining tube 48 is in turn held within housing 30 by lower shoulder 52 and upper flange 53 cooperating with housing shoulder 51.

A flexible rubber check valve 54 is positioned along the bottom of the retaining tube 48 to allow pressure equalization between the containers and the sprayer head assembly. Check valve 54 includes C-shaped flaps **54*a* (FIG. 1B) covering bores (not shown) extending lengthwise through retainer tube 48 and interconnecting each container with atmospheric pressure (through the spray head housing). Thus, any pressure build-up within containers 24 will be relieved through check valve 54. Check valve 54 also seals against the neck 47** of the fluid containers when the cap is screwed down on the containers to prevent leakage.

Figure 1A:
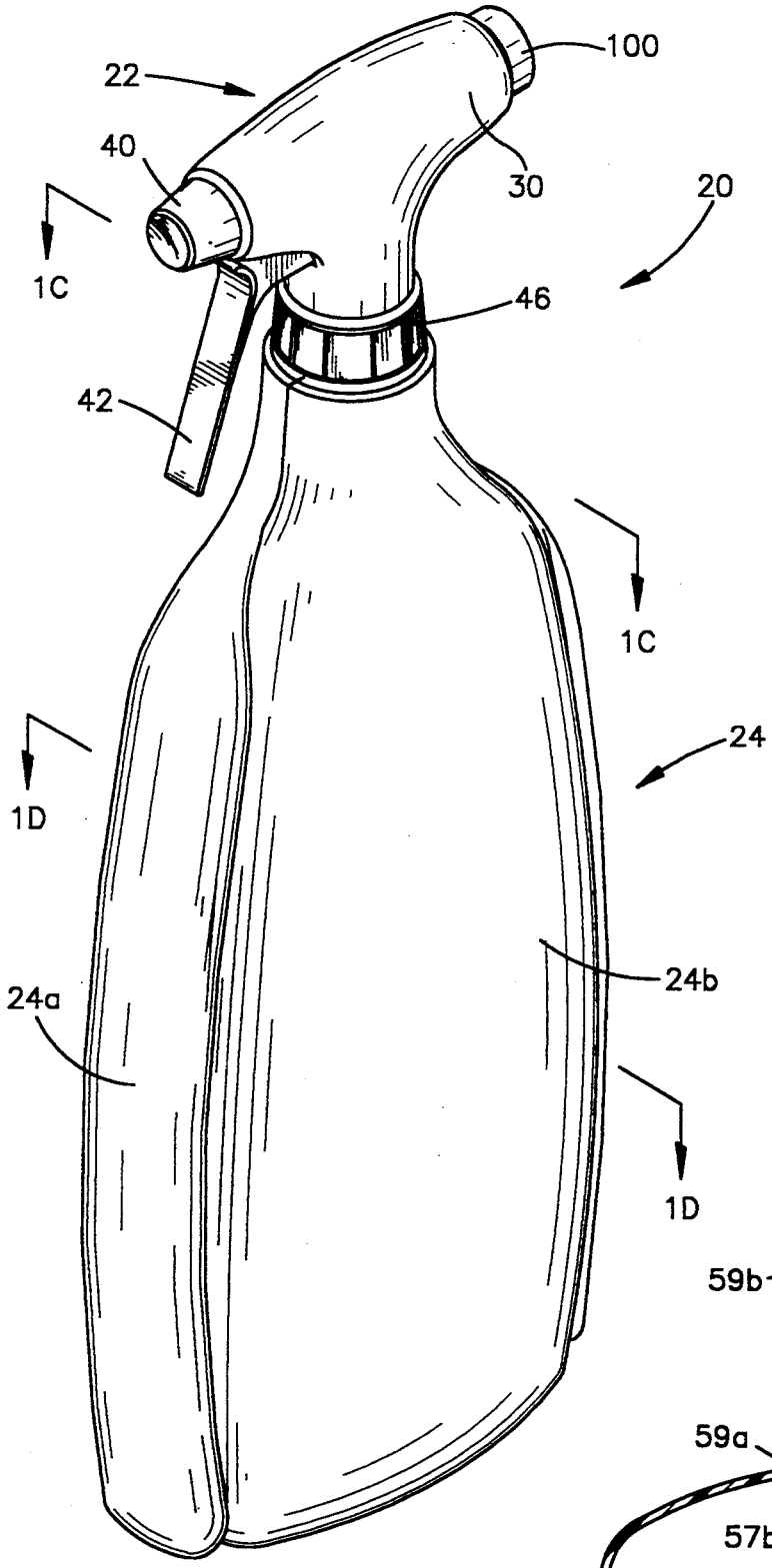
FIG. 1A is a perspective view of the assembled trigger sprayer constructed according to the principles of the present invention.
Figure 1C:
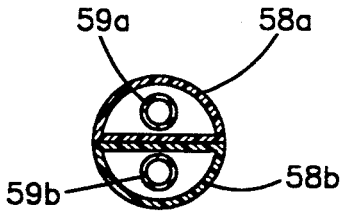
FIG. 1C is a cross-sectional top view of the containers for the trigger sprayer taken substantially along the place described by the lines 1C—1C of FIG. 1A.
Figure 1D:
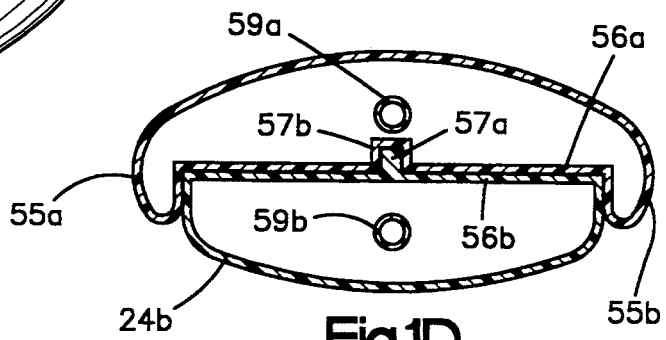
FIG. 1D is a cross-sectional top view of the containers taken substantially along the place described by the lines 1D—1D of FIG. 1A.
Figure 1B:
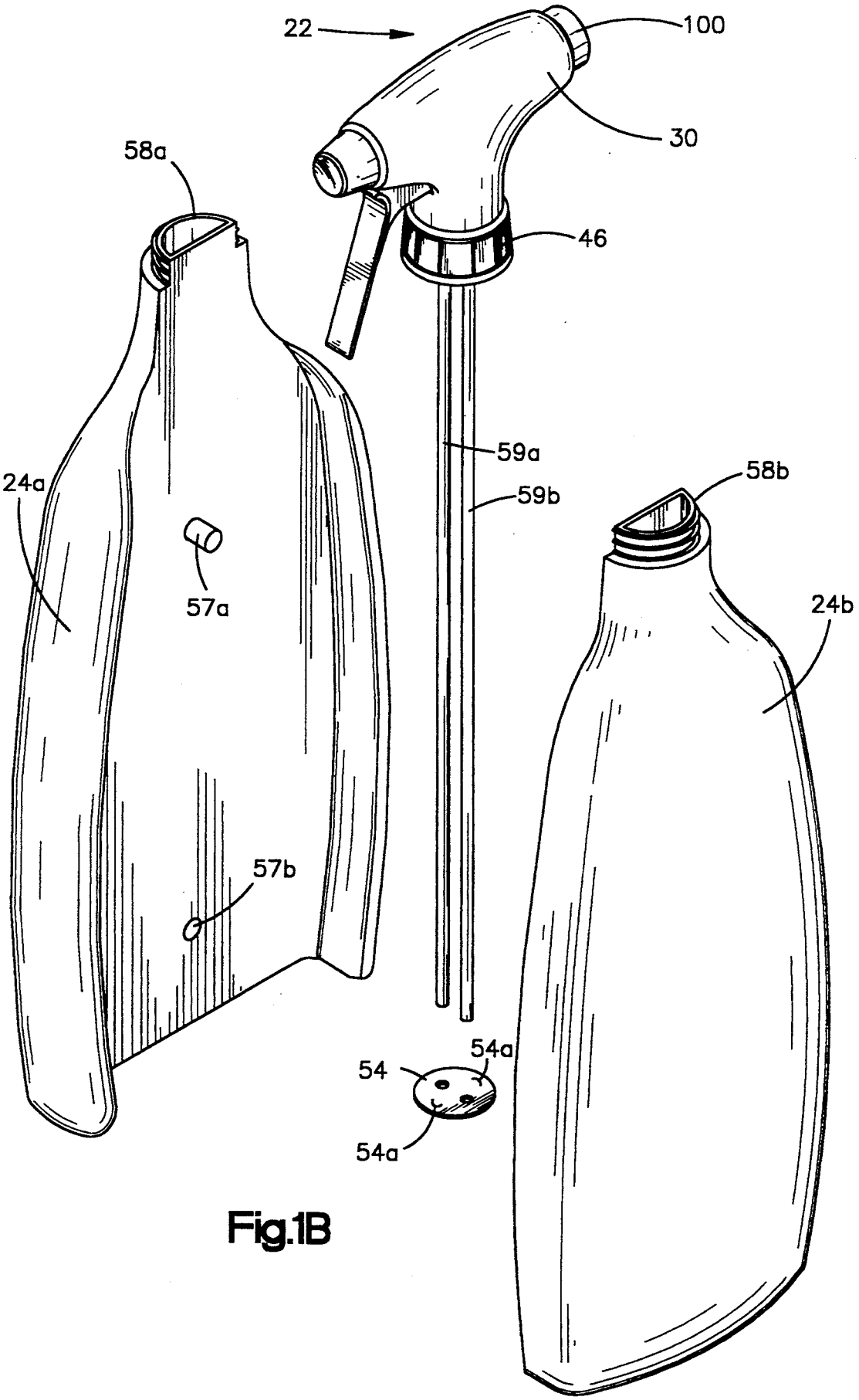
FIG. 1B is a disassembled view of the trigger sprayer of FIG. 1.

The containers for the trigger sprayer are preferably formed as two separate components and interfit with each other in an appropriate manner. Flanges, tongues, or other interconnecting structure can be formed on each container to cause the containers to releasably lock together. For example, as illustrated in FIGS. 1A and 1B, container **24*a* can include side portions 55*a*, 55*b* extending outwardly from opposite side edges of container 24*a*, and forming a cavity to receive container 24*b*. When container 24*a* and 24*b* are in face-to-face contact with each other, side portions 55*a* and 55*b* on container 24*a* partially surround or "wrap" around a portion of container 24*b* to in effect, couple one container to the other container. Moreover, inside surface 56*a* of container 24*a* is in flush, contacting relation with inside surface 56*b* of container 24*b*. If necessary or desirable, pins 57*a* can be formed on the contacting surface(s) of the containers to be received in corresponding recesses 57*b*** formed in the adjacent container to prevent relative movement between the containers.

When containers **24*a*, 24*b* are in interfitting relation as described above, the neck portions of the containers each form a portion of threaded neck 47 for attachment to the spray head assembly. Preferably the threaded neck 47 is comprised of D-shaped threaded neck portion 58*a* on container 24*a*, and D-shaped threaded neck portion 58*b* on container 24*b*. When containers 24*a*, 24*b* are in interfitting relation, D-shaped neck portions 58*a*, 58*b* cooperate to form the complete threaded neck 47. When the threaded neck 47 is screwed into cap 46, the cap 46 retains D-shaped neck portions 58*a*, 58*b* together and hence tightly secures container 24*a* and 24*b* together. Upon removing threaded neck 47 from cap 46**, however, the containers can be easily pulled apart and refilled, disposed of, etc. A filler cap (not shown) can also be included within the side of one or both containers to facilitate filling the container(s).

A pair of rigid rubber or plastic lower tubes **59*a*, 59*b* extend upwardly from the fluid containers, through the check valve 54 to openings formed in the retainer tube 48. Additional flexible upper tubes 60*a*, 60*b* continue upwardly from corresponding openings in retainer tube 48 to the metering device 36. Each lower tube 59*a*, 59*b* extends into a respective container, for example tube 59*a* extends into container 24*a*, while tube 59*b* extends into container 24*b***.

If desired, a key-way or other orientation device can be formed in cap 46 and/or container neck 47 so that tubes **59*a*, 59*b* can only be located in a predetermined container. In some cases it can be important to keep the tubes 59*a*, 59*b* associated with a specific container to prevent mixing of the fluids and to keep the ratio of the fluids being drawn through the metering device consistent. Alternatively to achieve this end, one of the containers can be formed with an inner tubing assembly which would replace the external tube within the container and which would be fluidly coupled within an appropriate recess or connection in the retainer tube 48**. Again, in this case the containers could only be attached to the spray head assembly with the tubing in a predefined container.

The upper tubes **60*a*, 60*b* terminate and are sealed within entrance openings formed in one of the components of the metering device, and in particular, terminate in the metering valve 61 of the metering device. For example, referring now to FIGS. 4–9, first tube 60*a* from container 24*a* terminates in entrance opening 62 of metering valve 61, while tube 60*b* terminates in entrance opening 64 of metering valve 61**.

The entrance openings 62, 64 extend inwardly from the side of the metering valve and terminate in axially-extending bores 66, 68, respectively. Bore 66 is located toward the periphery of the metering valve, while bore 68 is located toward the geometric axis of the metering valve. The bores 66, 68 extend inwardly and terminate at the inside surface 70 of the metering valve (see, e.g., FIGS. 6 and 8).

A pair of discharge openings 74, 76 are also formed axially through the metering valve and extend from inside surface 70 to the outside surface 72. Discharge bore 74 is interposed between entrance bore 66 and entrance bore 68, while discharge bore 76 is located next to entrance bore 68 toward the geometric axis of the metering valve.

A pair of circumferentially-extending channels 80, 82 are also formed on the inner surface 70 of the metering valve and terminate at entrance bore 66 and discharge bore 74, respectively. Both channels 80, 82 extend a substantial portion of the circumference of their respective circles, with the exact arcuate distance depending upon the particular situation, as will be apparent to those skilled in the art. It will also be apparent that circumferentially-extending channel 82 has a smaller radial arc than circumferentially-extending channel 80.

Figure 6:
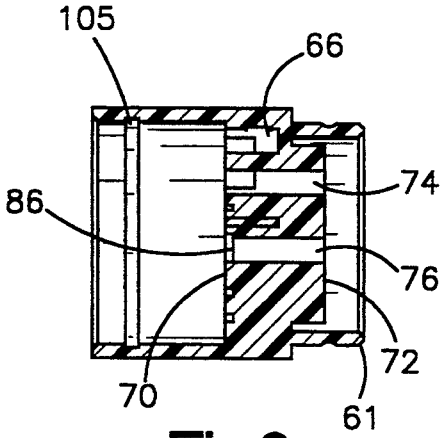
FIG. 6 is a cross-sectional side view of the metering valve taken substantially along the plane described by the line 6—6 of FIG. 5.
Figure 7:
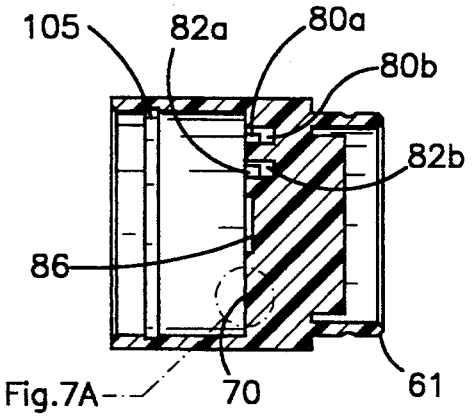
FIG. 7 is a cross-sectional side view of the metering valve taken substantially along the plane described by the line 7—7 of FIG. 5.
Figure 7A:
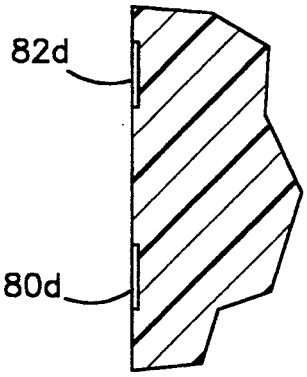
FIG. 7A is an enlarged, close-up view of a portion of the inner surface of the metering valve of FIG. 7.
Figure 8:
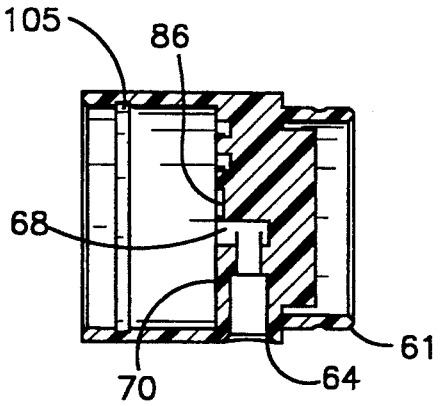
FIG. 8 is a cross-sectional, side view of the metering valve taken substantially along the plane described by the line 8—8 of FIG. 5.
Figure 9:
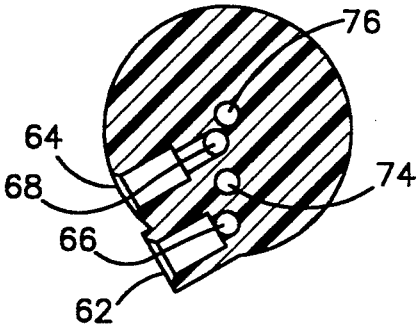
FIG. 9 is a cross-sectional end view of the metering valve taken substantially along the plane described by the line 9—9 of FIG. 4.
Figure 5A:
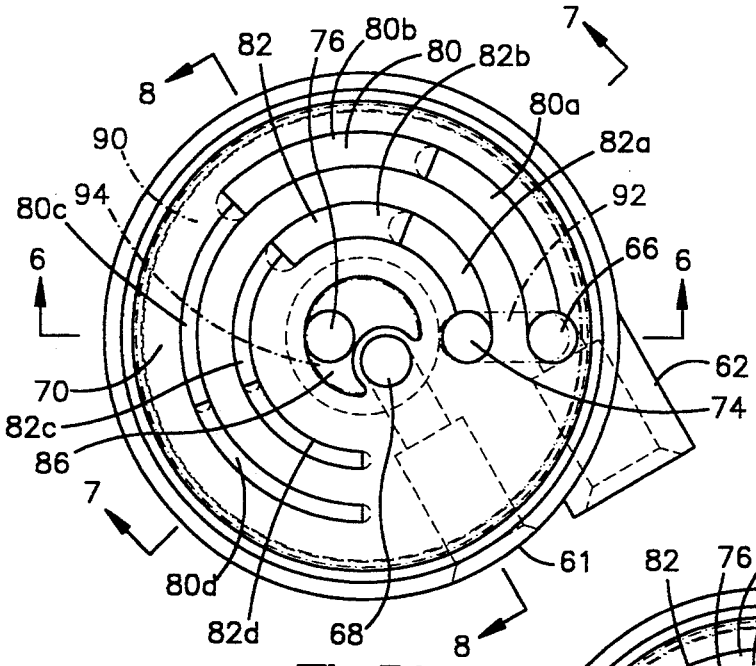
FIG. 5A is an end view of the metering valve of FIG. 4.
Figure 5B:
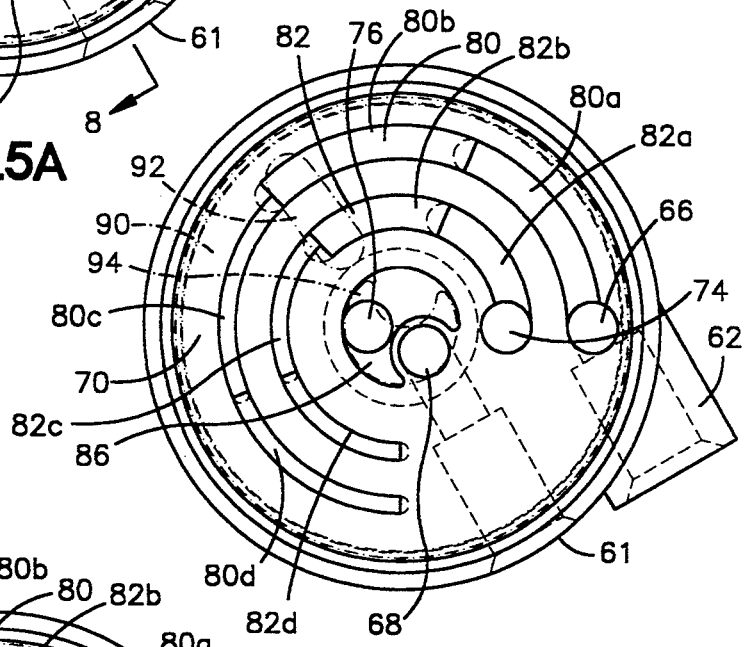
FIG. 5B is a schematic illustration of one relative arrangement of the metering valve and the bypass valve.
Figure 5C:
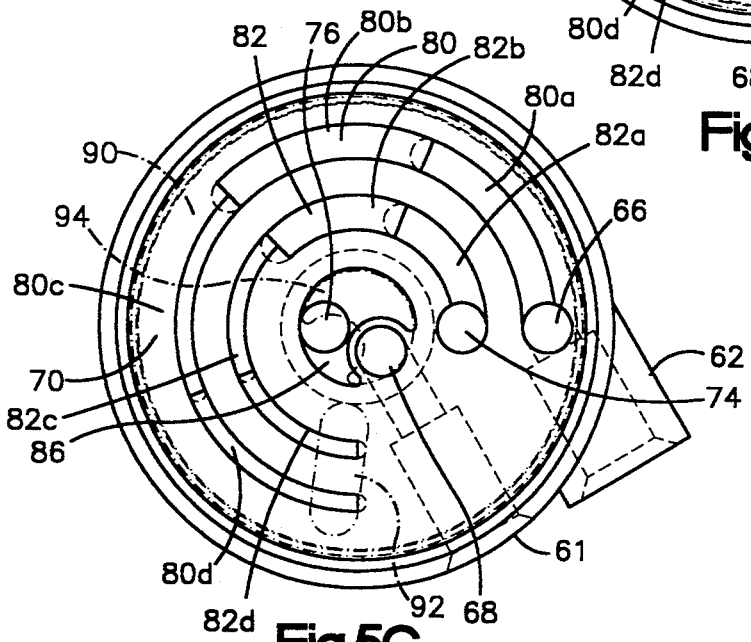
FIG. 5C is a schematic illustration of a second relative arrangement of the metering valve and the bypass valve.
Figure 10:
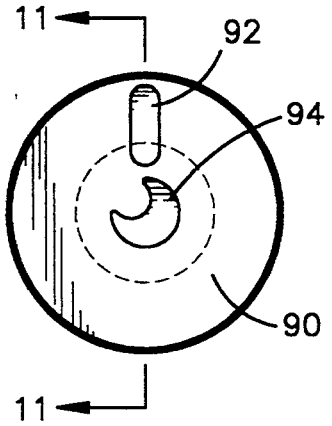
FIG. 10 is an end view of the bypass valve for the metering device.
Figure 11:
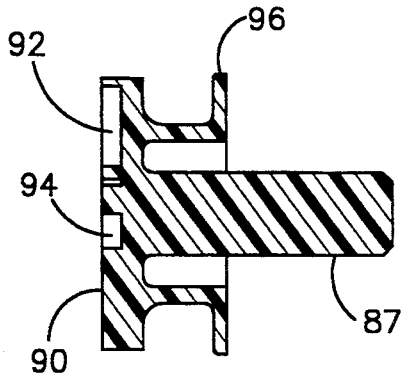
FIG. 11 is a cross-sectional side view of the bypass valve taken substantially along the plane described by the lines 11—11 of FIG. 10.

It should also be apparent upon comparing FIGS. 6–8 that the depth and width of circumferentially-extending channels 80, 82 varies along the length of the respective channel. In particular, the depth and width of each channel is greatest at the ends which terminate in bores 66, 74, while the depth and width narrows and is the least toward the distal ends 83, 84 of the channels. Again, the depth and width of the circumferentially-extending channels depends on the particular situations anticipated. It should be apparent upon viewing the figures, and particularly FIGS. 5 and 7, that the depth of the channels can change in discrete intervals, e.g., the depth can be at one level for segment **80*a*, and at another, lesser level for segment 80*b*; and likewise at one level for segment 82*a*, and at a lesser level for segment 82*b***. However, the depth of the channels can also vary in a continuous, uniform manner.

Finally, a crescent-shaped trough 86 is formed on inner surface 70 along the geometric axis of the metering valve. Exit bore 76 terminates in trough 86, while nearby entrance bore 68 is surrounded by (but does not contact or pass through) trough 86 (see, e.g., FIG. 5A).

The metering valve 61 is in contacting face-to-face relation with a second component of the metering device, namely a bypass valve, indicated generally at 87. The inside surface 90 of bypass valve 87 includes a bridge channel 92, located toward the outer periphery of the valve surface and preferably extending radially inward toward the geometric axis of the bypass valve, and a crescent-shaped trough 94 located toward the geometric axis of the valve. When the inner surface 90 of the bypass valve 87 is in face-to-face relation with the inner surface 70 of metering valve 61, the bridge channel 92 in the bypass valve extends across and interconnects circumferentially-extending channels 80, 82 in the metering valve 61 to form a first fluid flow path. Similarly, crescent-shaped trough 94 has a size which can extend between and interconnect entrance opening 68 and discharge opening 76 to form a second fluid flow path.

Thus, as should be apparent to those skilled in the art, the relative rotational orientation of the bypass valve 87 with respect to the metering valve 61 determines the amount of fluid flowing through the flow paths in the metering device 36. For example, if the bypass valve is positioned relative to the metering valve such that the bridge channel 92 is proximate entrance bore 66 and exit bore 74 (see, e.g., FIG. 5A), the flow path through the entrance opening 62 to discharge bore 74 will be short and direct. Fluid flow will travel from entrance bore 66 straight across bridge 92 to discharge bore 74. The fluid flow between the entrance and discharge bores is maximum in this orientation.

If the bypass valve is rotated with respect to metering valve through a small arc such that the bridge channel extends across channel segments **80*b* and 82*b* (see, e.g., FIG. 5B), then the fluid flow will be from entrance bore 66 through channel segments 80*a* and 80*b*, across bridge 92, through channel segments 82*b* and 82*a*, and to discharge bore 74. Moreover, the diameter of the orifice defined by the channels will also be smaller in this later situation because of smaller-diameter channel segments 80*b* and 82*b***, thereby resulting in a relatively lower flow rate through this flow path. The fluid flow between the entrance bore and discharge bore will be somewhat less in this instance than in the first case.

Finally, if the bypass valve and metering valve are positioned such that bridge channel 92 is proximate the distal ends 83, 84 of the circumferentially-extending channels (see, e.g., FIG. 5C), the flow path between entrance bore 66 and discharge bore 74 will be longer. Fluid flow will travel through channel segments **80*a*, 80*b*, 80*c* and 80*d*, across bridge 92, through channel segments 82*d*, 82*c*, 82*b* and 82*a*, to discharge bore 74. Moreover, the diameter of the orifice defined by the channels will also be smaller in this later situation because of smaller-diameter channel segments 80*b*, 80*c*, 80*d*, and 82*b*, 82*c*, 82*d*, thereby resulting in a relatively lower flow rate through this flow path. Thus, the relative positioning of the bypass valve and the metering valve determines the fluid flow rate from the entrance opening 62 to the discharge bore 74**.

Similarly, the relative positioning of the bypass valve 87 with respect to the metering valve 61 affects the flow rate from the second entrance opening 64 to the second discharge bore 76. In particular, when the crescent-shaped trough 94 on the bypass valve 87 is aligned with crescent-shaped trough 86 on the metering valve 61 (FIG. 5B), the second flow path will be interrupted or closed between entrance bore 68 and discharge bore 76. The bypass valve can be rotated, however, such that at least a portion of the crescent-shaped trough 94 on bypass valve 87 provides a fluid flow path between the entrance bore 68 and the discharge bore 76 (e.g., FIGS. 5B, 5C), with the flow rate being determined by the relative alignment of the trough 94, trough 86 and the entrance and discharge bores.

The bridge channel 92 and crescent-shaped trough 94 allow for a wide range of fluid ratios passing through the metering device 36. In one extreme rotational orientation (FIG. 5A), fluid flowing through first entrance bore 68 will be almost entirely blocked, or can be entirely blocked; while maximum flow will occur between second entrance bore 66 and discharge bore 74. The metering device can be adjusted by rotating the bypass valve with respect to the metering valve (FIG. 5C) such that maximum flow rate occurs between entrance bore 68 and discharge bore 76, and that minimum (or no) flow rate occurs between entrance bore 66 and discharge bore 74. The maximums and minimums of the flow paths can be adjusted depending upon the particular requirements (e.g., by adjusting the length and diameter of the circumferentially-extending channels). Further, as will be described herein in more detail, the fluids flowing through the metering device are then mixed and discharged through the nozzle in the selected ratio.

In order that bypass valve 87 can be rotated relative to metering valve 61, metering valve 61 is secured to support structure on housing 30, such as by a key and slot or in another manner whereby rotational movement of the metering valve 61 is prevented. As will be described herein in more detail, metering valve 61 is also supported within housing 30 for reciprocal movement therein.

The bypass valve 87 is rotatably supported in housing 30 by the outwardly-extending end wall 95 of metering valve 61. Outwardly-extending flange 96 on bypass valve 87 is received within a groove 97 formed on the inside surface of end wall 95 (see, e.g., FIG. 2A) to retain bypass valve 87 in contact with metering valve 61. Flange 96 acts as a cantilever spring to provide a slight amount of pressure between the contacting surfaces of the bypass valve and the metering valve.

Figure 12:
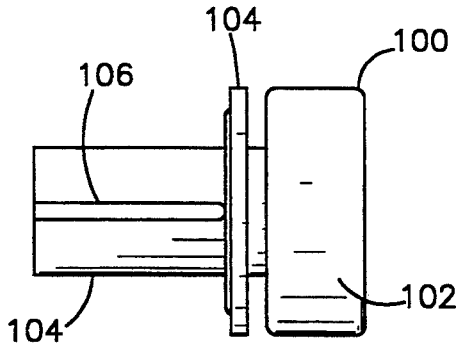
FIG. 12 is a side view of the adjustment knob for the bypass valve.
Figure 13:
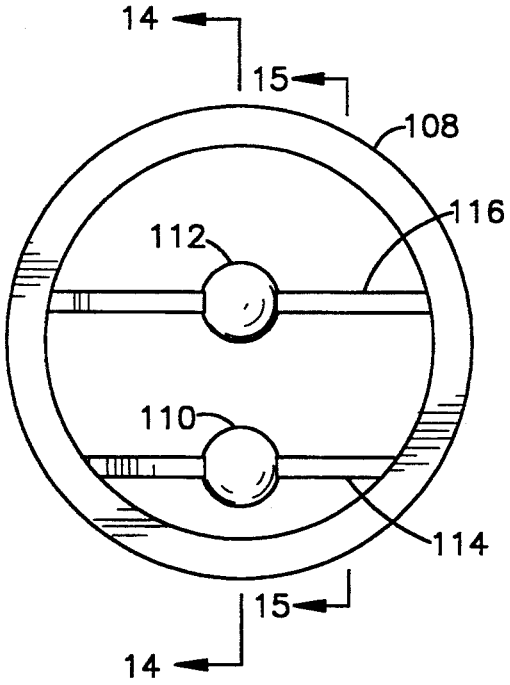
FIG. 13 is a plan view of the gasket or check valve for the metering valve.
Figure 14:
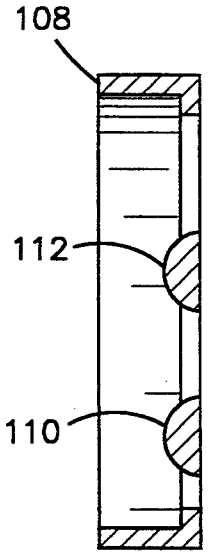
FIG. 14 is a cross-sectional side view of the check valve taken substantially along the plane described by the lines 14—14 of FIG. 13.
Figure 15:
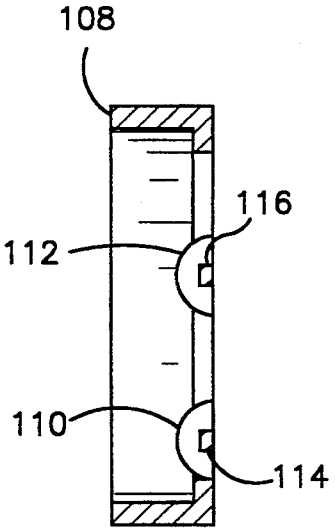
FIG. 15 is a cross-sectional side view of the check valve taken substantially along the plane described by the lines 15—15 of FIG. 13.

An adjustment knob 100 (FIGS. 2A, 2B) is connected to a rearwardly-extending post 101 on bypass valve 87 and extends outwardly through the spray housing 30 for access by the user. As illustrated in detail in FIG. 12, knob 100 includes a head 102 and a post 103 extending outwardly therefrom. Head 102 can have indexed graduation to facilitate rotation of the knob to a selected orientation, while post 103 includes outwardly-projecting flange 104 which is rotatingly received within a groove 105 formed in housing 30. Post 103 includes a lengthwise-extending groove or slot 106 which is designed to receive and interfit with a tongue 106 (FIG. 3) mounted on post 101 of bypass valve 87. Alternatively, post 103 on knob 100 can have a hex or square cross sectional inner bore which can receive a similarly-shaped post 101 on bypass valve 87. In any case, when head 102 of knob 100 is turned, bypass valve 87 is likewise turned relative to metering valve 61.

Referring now to FIGS. 1–3 and 13–15, a flexible rubber gasket 108 is located adjacent the outer surface 72 of metering valve 61. Gasket 108 serves as one-way check valve for the discharge bores 74, 76, in metering valve 61. Gasket 108 includes a pair of hemispherical valve elements 110, 112 supported by arms 114, 116, respectively, extending between and interconnecting the outer, ring-like frame of the gasket 108. Each valve element 110, 112 is received within a respective discharge bore 74, 76 to prevent fluid from flowing back through the metering device to the fluid containers. As will be described herein in more detail, the gasket 108 thereby prevents mixing of fluids between the two fluid containers.

Referring now to FIGS. 2–3 and 16, 17, the pump mechanism 34 for the trigger sprayer comprises piston 120 and cylinder 124, which interfit and move relative to each other. Piston 120 includes an outwardly-extending flange 126 which is received within a groove 127 in the spray head housing 30 and is thus fixedly secured thereto. The piston 120 includes a neck portion 128 which extends outwardly through the housing 30 into a ring-shaped bore 134 formed in nozzle 40. The neck portion 128 is flared outwardly at its distal end 135 to form a fluid-tight seal with bore 134.

A spring check valve 140 extends lengthwise through bore 144 in piston 120 to regulate the flow of fluid therethrough. The spring check valve includes a central post 145 with one end having a cone-shaped head 146 which is designed to seat within an aperture 147 formed in the end of bore 144. The other end of the central post includes a seat 148 which can abut passageway 150 formed in nozzle 40. When nozzle 40 is screwed tightly against housing 30 (see, e.g., FIG. 2A), the inner surface of the passageway 150 contacts seat 148 on central post 145, and thereby forces the head 146 into sealing engagement with aperture 147, thus preventing fluid flow through the piston (i.e., the closed or locked position). When the nozzle is unscrewed (see, e.g., FIG. 2B), a spring 152 biases the seat 145 away from the inner surface of the passageway 150 to allow fluid to flow outwardly through the piston bore to nozzle 40 (i.e., the open or unlocked position). Spring 152 normally urges head 146 against aperture 147, but permits head 146 to move away from aperture 147 when fluid is being discharged through bore 144. Check valve head 146 also seals aperture 147 to form a vacuum within cylinder 124 when the trigger is released, as will be described herein in more detail.

Figure 16:
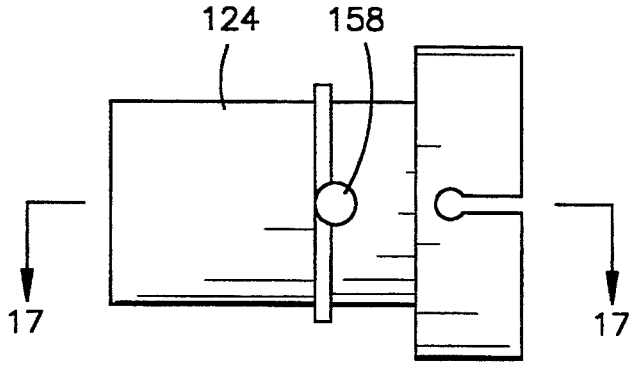
FIG. 16 is a side view of the cylinder for the sprayer head.
Figure 17:
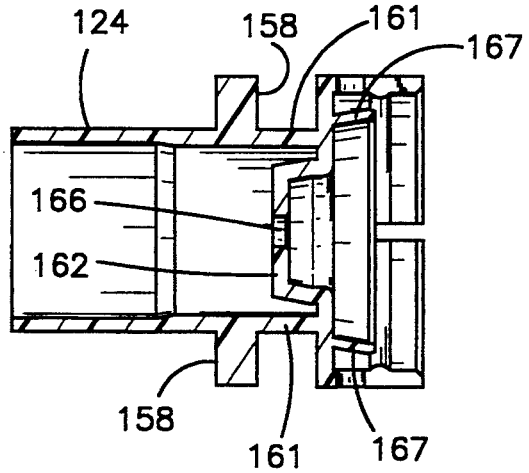
FIG. 17 is a cross-sectional side view of the cylinder taken substantially along the plane described by the lines 17—17 of FIG. 16.

As indicated previously, cylinder 124 partially surrounds and is movable relative to piston 120. Return spring 154 surrounds cylinder 124 and engages flange 156 to urge the cylinder away from nozzle 40. As seen in FIGS. 16 and 17, outwardly-extending posts 158 on opposite sides of cylinder 124 are engaged by claws on trigger 42 (one of which is shown at 159) to urge the cylinder toward the nozzle 40 when the trigger is squeezed.

A cylinder discharge chamber, indicated generally at 160, is formed by the side walls 161 and upper wall 162 of cylinder 124, and an entrance mouth 163 of piston 120. The discharge chamber 160 is interconnected with a cylinder mixing chamber 164 through orifice 166 formed in upper wall 162. The mixing chamber 164 is formed by upper wall 162, side walls 167 of the mouth of the cylinder, and the outer surface 72 of metering valve 61.

Manually squeezing trigger 42 urges cylinder 124 against its spring bias toward the nozzle 40 and closer to piston 120. By virtue of check valves 110, 112 on gasket 108 preventing fluid from flowing back through the metering device (see, e.g., FIG. 13), any fluid within discharge chamber 159 will be forced through piston bore 144 (thus unseating head 146 from aperture 147), and out through passageway 150 of nozzle 40. When the trigger is at its maximum point of travel, upper wall 162 of cylinder 124 will snugly fit within entrance mouth 163 of piston 120 for maximum fluid displacement.

When trigger 42 is released, spring 154 biases cylinder 124 away from nozzle 40. At this point, spring 152 in piston bore 144 biases check valve 140 into engagement with aperture 147. This causes a vacuum within discharge chamber 159 and mixing chamber 164 (through aperture 166), thereby drawing fluid up from the containers, through the metering device 36, and into mixing chamber 164, where the fluids are mixed. Any fluid which was previously within mixing chamber 164 is displaced at this time into discharge chamber 159 (through orifice 166) when the trigger 42 is released. Thus, the first stroke of the trigger 42 causes fluid to be drawn into the mixing chamber, where the fluid is caused to mix; while the next (and subsequent) stroke of the trigger causes the fluid within mixing chamber 164 to flow into discharge chamber 159 and out through the nozzle 40. Again, when the trigger is released, the mixed fluid within mixing chamber 164 flows into discharge chamber 159 for discharge during the subsequent trigger stroke.

As discussed previously, the ratios of fluid drawn from the containers can be easily and simply adjusted by manually turning knob 100. Thus, the amount of concentrate drawn from the containers can be adjusted for a particular spray application. Finally, when the trigger sprayer is no longer needed, nozzle 40 can be tightened down into the locked position to prevent lever 42 from unintentionally being squeezed and spraying the fluid.

Although the invention has been described with respect to a pair of fluid containers for supplying two different types of fluid to the pump mechanism through the metering device, the principles of the present invention are likewise applicable to a trigger spray with more than two fluid containers, for example three fluid containers. The metering device and associated components could be easily modified in this case, for example by having two pairs of circumferentially-extending channels formed in the face of the metering valve, such that the ratio of fluid from the three (or more) fluid containers is varied when adjustment knob 100 is turned. Additional modifications along the same lines should be further apparent to those skilled in the art.

The principles, embodiments and modes of operation of the present invention have been described in the foregoing specification. The invention which is intended to be protected herein should not, however, be construed to the particular formed described, as it is to be regarded as illustrative rather than restrictive. Variations and changes may be made by those skilled in the art without departing from the spirit of the present invention. Accordingly, the foregoing detailed description should be exemplary in nature and not as limiting as to the scope and spirit of the invention set forth in the appended claims.

What is claimed is:

1. A spray device, comprising a spray head assembly designed to be removably connected to a plurality of fluid containers, said spray head assembly including: i) a housing, ii) a nozzle, iii) a pump mechanism enclosed within said housing, iv) tubing for fluidly connecting each of said plurality of fluid containers with said pump mechanism, v) a trigger for actuating said pump mechanism and drawing fluid through said tubing from each of said plurality of fluid containers for discharge through said nozzle, and vi) a metering device for controlling the amount of fluid drawn through the tubing from at least one of said fluid containers, said metering device providing a flow path to said pump mechanism from said at least one fluid container, said metering device including a first metering component and a second metering component, said first and second metering components having contacting surface portions defining said flow path, the relative positioning of the metering components relative to each other defining the diameter and length of said flow path, wherein said first metering component is accessible externally from said spray head housing and selectively rotatable around a first axis normal to said contacting surface portion, and said second metering component is fixed against rotational movement relative to said spray head housing.

2. The spray device as in claim 1, wherein said second metering component includes an entrance opening and a discharge opening, said entrance opening being fluidly connected to said one fluid container by said tubing, and said discharge opening being fluidly connected to said pump mechanism.

3. The spray device as in claim 2, wherein said contacting surface on one of said first or second components includes a pair of circumferentially extending channels, one of said circumferentially extending channels extending from said entrance opening to define a portion of said one flow path, and the other of said circumferentially extending channels extending from said discharge opening to define another portion of said one flow path, at least one of said circumferentially-extending channels having a variable diameter across the length of the channel, and said contacting surface of the other of said first or second components including a bridge channel which extends across and interconnects said pair of circumferentially-extending channels, the relative positioning of said first and second metering components relative to each other defining the location of the bridge channel along the circumferentially extending channels and thereby defining the length and diameter of the flow path through the entrance opening, through one of the circumferentially extending channels, across the bridge channel, through the other of the circumferentially extending channels and out through the discharge opening.

4. The spray device as in claim 3, wherein said metering device further defines a second flow path from another of said fluid containers to said pump mechanism, said pump mechanism including a mixing chamber for receiving fluid from both the first and second flow paths.

5. The spray device as in claim 4, wherein the pump mechanism further includes a discharge chamber, and a orifice interconnecting said mixing chamber and said discharge chamber, said fluid flowing from said each of said fluid containers through said metering device and into said mixing chamber when said trigger is actuated, and through said orifice and into said discharge chamber for discharge through the nozzle when said trigger is released.

6. The spray device as in claim 1, wherein said metering device further provides a second flow path between another of said containers and said pump mechanism, wherein said second flow path can also be controlled by manually manipulating the metering device for controlling the amount of fluid drawn through the tubing from another of said plurality of containers.

7. The spray device as in claim 1, further including a plurality of containers designed to be removably connected to said spray head assembly.

8. The spray device as in claim 7, wherein each of said plurality of containers includes coupling structure that cooperates with corresponding coupling structure on an adjacent container to removably couple the containers together.

9. The spray device as in claim 7, wherein said spray head assembly includes a cap designed to receive a neck of said containers to removably couple said containers to said spray head assembly.

10. The spray head assembly as in claim 9, wherein each of said containers has a portion which cooperates with a portion from an adjacent container to form said container neck.

11. A spray device, comprising a spray head assembly designed to be removably connected to a plurality of fluid containers, said spray head assembly including: i) a housing, ii) a nozzle, iii) a pump mechanism enclosed within said housing, iv) tubing for fluidly connecting each of said plurality of fluid containers with said pump mechanism, v) a trigger for actuating said pump mechanism and drawing fluid through said tubing from each of said plurality of fluid containers for discharge through said nozzle, and vi) a metering device providing a flow path to said pump mechanism for each of said plurality of fluid containers, said metering device being accessible externally from the housing and having components in face-to-face, moveable relation with each other, each face of the components in face-to-face relation being essentially flat and defining a portion of the flow path for each of the containers to selectively control the amount of fluid drawn through the tubing from each of said plurality of fluid containers.

12. A spray device, comprising a spray head assembly designed to be removably connected to a plurality of fluid containers, said spray head assembly including: i) a housing, ii) a nozzle, iii) a pump mechanism enclosed within said housing, iv) tubing for fluidly connecting each of said plurality of fluid containers with said pump mechanism, v) a trigger for actuating said pump mechanism and drawing fluid through said tubing from each of said plurality of fluid containers for discharge through said nozzle, and vi) a metering device for providing a first flow path to said pump mechanism for one of said plurality of fluid containers, said metering device including a first metering component and a second metering component, said first metering component defining a first essentially flat contacting surface, said second metering component defining a second essentially flat contacting surface, a first portion of said flow path being defined in said first essentially flat contacting surface and a second portion of said flow path being defined in said second essentially flat contacting surface, said first and second essentially flat contacting surfaces being arranged in mating relationship so that the first and second portions of said flow path communicate with one another, said first and second essentially flat contacting surfaces being adapted to slide with respect to one another so that said first and second portions of said flow path cooperate to vary the length and diameter of said flow path in response to the relative positioning of said first and second metering components, said metering device being accessible externally from the housing and being manually manipulatable for varying the diameter and length of said flow path and thereby controlling the amount of fluid drawn through the tubing from said one fluid container.

13. The spray device of claim 12, wherein said first and second metering components are rotatable with respect to one another such that said first and second essentially flat surfaces rotate with respect to one another along an axis normal to said surfaces.

14. The spray device of claim 13, wherein said first metering component is accessible externally from said spray head housing and is selectively rotatable about said axis, and further wherein said second metering component is fixed against rotational movement relative to said spray head housing.

15. The spray device of claim 14, wherein at least one of said first and second portions of said flow path are defined by a channel having a variable diameter across the length thereof.

16. The spray device of claim 15, wherein said channel having a variable diameter is defined in said second essentially flat contacting surface and extends circumferentially around said axis.

17. The spray device of claim 16, wherein said metering device further defines a second flow path for connecting another of said fluid containers to said pump mechanism, said second flow path being separate and distinct from said first flow path whereby fluid in said first flow path and fluid in said second flow path do not mix prior to passing out of said metering device.

18. The spray device of claim 17, wherein said pump mechanism includes a mixing chamber for separately receiving fluids passing out of the first and second flow paths in said metering device.

19. The spray device of claim 18, wherein the flow rate of fluid passing through said second flow path is also controlled by manually manipulating said metering device.

20. A spray device comprising, a spray head assembly designed to be removably connected to a plurality of fluid containers, said spray head assembly including: i) a housing, ii) a nozzle, iii) a pump mechanism enclosed within said housing, iv) tubing for fluidly connecting each of said plurality of fluid containers with said pump mechanism, v) a trigger for actuating said pump mechanism and drawing fluid through said tubing from each of said plurality of fluid contains for discharge through said nozzle, and vi) a metering device for providing a first flow path to said pump mechanism for one of said plurality of fluid containers and a second flow path to said pump mechanism for another of said plurality of fluid containers, said metering device including a first metering component and a second metering component, said first metering component and said second metering component together defining said first flow path and said flow path, said first flow path and said second flow path being separate and distinct in said metering device so that fluids received in said first and said second flow paths are discharged from said metering device without mixing therein, said first and said second metering components being movable with respect to one another and cooperating to vary the diameter and length of at least one of said flow paths in response to relative movement thereof, said metering device being accessible externally from the housing for manual manipulation thereof.

21. The spray device of claim 20, wherein said pump mechanism includes a mixing chamber for receiving fluid from both said first and said second flow paths.

22. The spray device of claim 21, wherein said first metering component defines a first essentially flat contacting surface and said second metering component defines a second essentially flat contacting surface, said first and second flat contacting surfaces being arranged in mating relationship and adapted to slide with respect to one another in response to relative movement of said first and said second metering components.

23. The spray device of claim 22, wherein at least one of said first and second essentially flat contacting surfaces includes a channel defining at least a portion of said first or second flow path, said channel having a variable diameter across the length thereof.

24. The spray device of claim 23, wherein said first and said second essentially flat contacting surfaces are arranged to rotate with respect to one another along an axis normal to said surfaces.

25. The spray device of claim 24, wherein said first flow path is defined by at least one channel in one of said essentially flat contacting surfaces and another channel in the other essentially flat contacting surfaces, said at least one channel having a variable diameter across the length of the channel, said at least one channel and said another channel cooperating to vary the length and diameter of said first flow path in response to relative movement of said first and second metering components, said second flow path being defined by a first crescent shaped channel in said first essentially flat contacting surface and a second crescent shaped channel in said second contacting surface, said first crescent shaped channel and said second crescent shaped channel cooperating to vary the size of said second flow path in response to relative movement of said first metering component and said second metering component.

* * * * *